US009083109B2

(12) United States Patent
Tetsuya

(10) Patent No.: US 9,083,109 B2
(45) Date of Patent: Jul. 14, 2015

(54) CONNECTOR CAP WATERPROOF STRUCTURE

(71) Applicant: SONY MOBILE COMMUNICATIONS AB, Lund (SE)

(72) Inventor: Okuchi Tetsuya, Tokyo (JP)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 140 days.

(21) Appl. No.: 14/026,888

(22) Filed: Sep. 13, 2013

(65) Prior Publication Data

US 2014/0080334 A1 Mar. 20, 2014

Related U.S. Application Data

(60) Provisional application No. 61/703,294, filed on Sep. 20, 2012.

(51) Int. Cl.

| | |
|---|---|
| ***H01R 13/44*** | (2006.01) |
| ***H01R 13/52*** | (2006.01) |
| ***H01R 13/447*** | (2006.01) |

(52) U.S. Cl.

CPC ..... *H01R 13/5213* (2013.01); *H01R 13/447* (2013.01); *H01R 2201/06* (2013.01)

(58) Field of Classification Search

CPC ..... H01R 13/5213; H01R 13/447; H01R 2201/06

USPC ..... 439/135–136, 149

See application file for complete search history.

(56) References Cited

U.S. PATENT DOCUMENTS

| | | | | | |
|---|---|---|---|---|---|
| 2,452,922 | A | * | 11/1948 | Gonsett et al. | 174/67 |
| 4,138,187 | A | * | 2/1979 | Brygger | 439/142 |
| 4,250,349 | A | * | 2/1981 | Bennett | 174/67 |
| 4,795,354 | A | * | 1/1989 | Owen | 439/137 |
| 2013/0029507 | A1 | * | 1/2013 | Yang | 439/148 |

FOREIGN PATENT DOCUMENTS

| | | |
|---|---|---|
| JP | 2010-186562 | 8/2010 |

* cited by examiner

*Primary Examiner* — Khiem Nguyen

(74) *Attorney, Agent, or Firm* — Oblon, McClelland, Maier & Neustadt, L.L.P.

(57) ABSTRACT

A connector cap for use in a portable electronic device including a base; a connector-facing portion formed integrally with the base; and a sealing member formed of an elastic material in a ring-like shape and joined to the base, wherein the connector-facing portion includes a flexible member that has an elongated shape and is configured to extend away from the base and toward an inside of a casing of the portable device, wherein the flexible member is disposed from a position on the connector-facing portion that is within an inner area enclosed by the ring-like shape of the sealing member.

11 Claims, 18 Drawing Sheets

CONNECTOR CAP WATERPROOF STRUCTURE

CROSS REFERENCE TO RELATED APPLICATIONS

This application is related to and claims priority under 35 U.S.C. §119(e) to Provisional Application Ser. No. 61/703,294, filed Sep. 20, 2012, the contents of which are hereby incorporated herein by reference.

FIELD

The present specification relates to a connector cap having a waterproof function and a waterproof structure therefor.

DESCRIPTION OF THE RELATED ART

Portable electronic devices, such as mobile phone terminals and so-called smart phones, have connectors via which various external devices, such as universal serial bus (USB), SD memory card, subscriber identity module (SIM) card, and audio jack, are connected thereto. These connectors are typically provided with caps (or covers) for covering connector openings provided in casings.

To add a waterproof function to these electronic devices, a waterproof structure for connector caps is employed. PTL 1 proposes a waterproof structure that seals a connector opening for a communication port of an electronic device in a watertight manner. In this prior art, a waterproof member is disposed on an outer side or on an inner side of a projection that is "formed in a ring-like shape" and is fitted to the connector opening.

FIGS. 1(*a*) to 1(*c*) show a configuration example of a conventional connector cap. FIG. 1(*a*) shows a cross-sectional view of an electronic device to which a cap 105 is fitted. FIG. 1(*b*) is a cross-sectional view of a portion of a casing 160 in a state in which the cap 105 is removed from the casing. FIG. 1(*c*) is an external view of a connector opening 163, as viewed from the front thereof, in a state in which the cap 105 is removed.

A connector 150 is disposed inside the connector opening 163 that is provided in the casing 160 of the electronic device and is open to the outside. The cap 105 has, on an inner surface thereof, a ring-like raised portion 113 having a periphery of a size corresponding to the connector opening 163, and a waterproof member 120 made of rubber or elastomer is formed so as to cover the raised portion 113. When the cap 105 is inserted into the connector opening 163, the waterproof member 120 elastically fits to the opening 163.

The cap 105 has, on the outer side of the periphery of the ring-like waterproof member 120, a flexible member 131 protruding in a tongue-like shape toward the inside thereof. This flexible member 131 is a member that serves as a so-called hinge portion of the cap 105. Therefore, the flexible member 131 has a hook portion 131*a* at a tip, and the hook portion 131*a* is engaged with an engaging portion 165 near an outlet of the electronic device when the cap 105 is removed from the electronic device, and the flexible member 131 is pulled out. Thus, loosing the cap is prevented. In this example, the cap 105 also has a claw portion 135 having a hook portion 136 at a tip, at the opposite end of the cap from the flexible member 131. This claw portion 135 is also located on the outer side of the periphery of the ring-like waterproof member 120.

The casing 160 includes casing portions 160*a* and 160*b*. One of the casing portions, 160*b*, is provided with the connector opening 163, and openings 161 and 162 are provided on both sides thereof. The opening 161 receives the flexible member 131 of the cap 105. The opening 162 receives the claw portion 135 of the cap 105.

CITATION LIST

Patent Literature

[PTL 1] Japanese Unexamined Patent Application Publication No. 2010-186562

In the above-described configuration of the prior art, because the flexible member 131 and the claw portion 135 are formed on the outer side of the periphery of the ring-like waterproof member 120 that seals the connector opening 163, the openings 161 and 162 have to be provided in the casing, separately from the connector opening 163. Furthermore, a gasket 130 for waterproofing these openings 161 and 162 is additionally required, making the waterproof structure complex.

The present specification has been made under the circumstances, and the inventor realizes the need for a connector cap waterproof structure having a relatively simple configuration.

BRIEF SUMMARY

A connector cap waterproof structure according to an embodiment includes a casing of an electronic device; a connector disposed inside a connector opening provided in the casing; and a connector cap that fits to the connector opening in a watertight manner. The connector cap includes a base; a sealing member formed in a ring-like shape on a periphery of the base; and a flexible member that is formed integrally with the base and extends in a tongue-like shape toward the inside of the casing. The flexible member includes a hook portion at a free end thereof so as to be engaged with an engaging portion of the casing when the connector cap is removed from and pulled out of the connector opening. The flexible member is provided in an inner area enclosed by the ring-like sealing member.

A connector cap according to an embodiment is a connector cap that fits to a connector opening provided in a casing of an electronic device in a watertight manner. The connector cap includes a base; a sealing member formed in a ring-like shape on a periphery of the base; and a flexible member that is formed integrally with the base and extends in a tongue-like shape toward the inside of the casing. The flexible member includes a hook portion at a free end thereof so as to be engaged with an engaging portion of the casing when the connector cap is removed from and pulled out of the connector opening. The flexible member is provided in an inner area enclosed by the ring-like sealing member.

Because the flexible member is provided in the inner area enclosed by the ring-like sealing member, a need to provide an opening other than the connector opening in the casing cap, in relation to the connector cap, is eliminated. Furthermore, waterproofing measures for other openings become unnecessary.

DETAILED DESCRIPTION

Figure 1A:
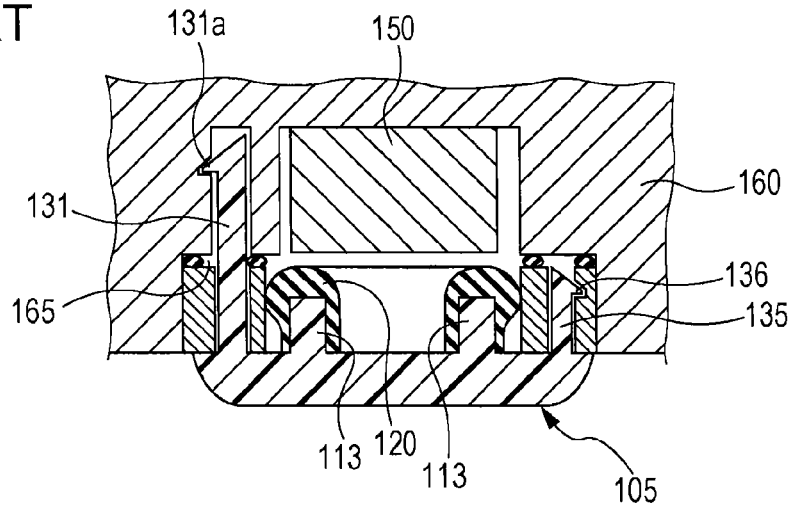
FIG. 1A PRIOR ART
FIGS. 1A, 1B, and 1C are diagrams showing a configuration example of a conventional connector cap.
Figure 1B:
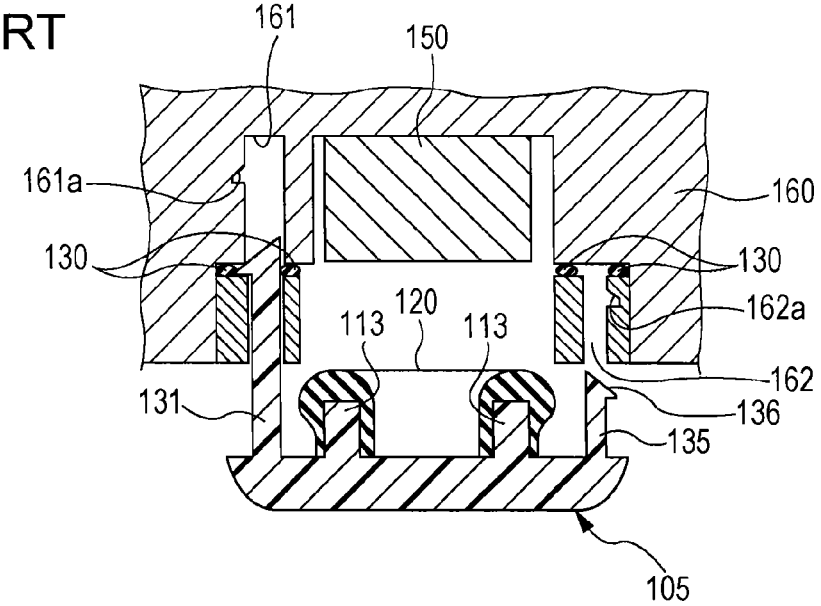
FIG. 1B PRIOR ART
Figure 1C:
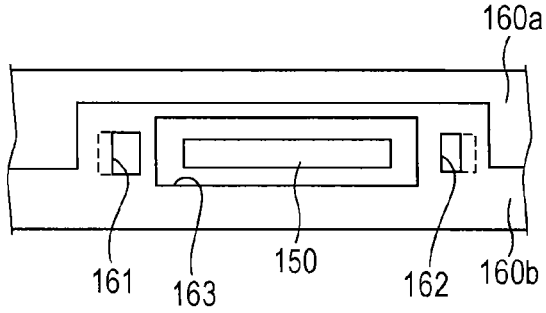
FIG. 1C PRIOR ART
Figure 2A:
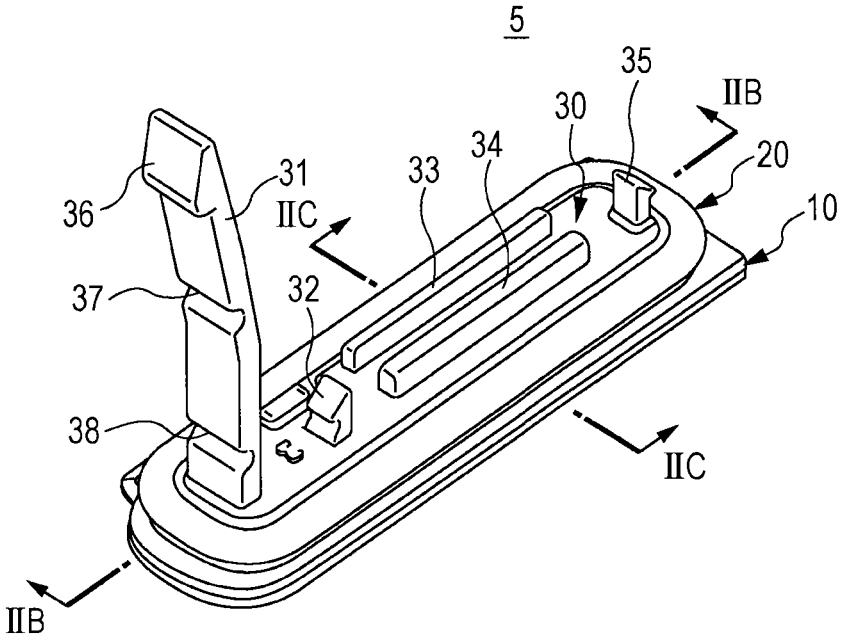
FIGS. 2A, 2B, 2C, and 2D are diagrams for explaining the structure of a connector cap (connector cover) according to an embodiment.
Figure 2B:
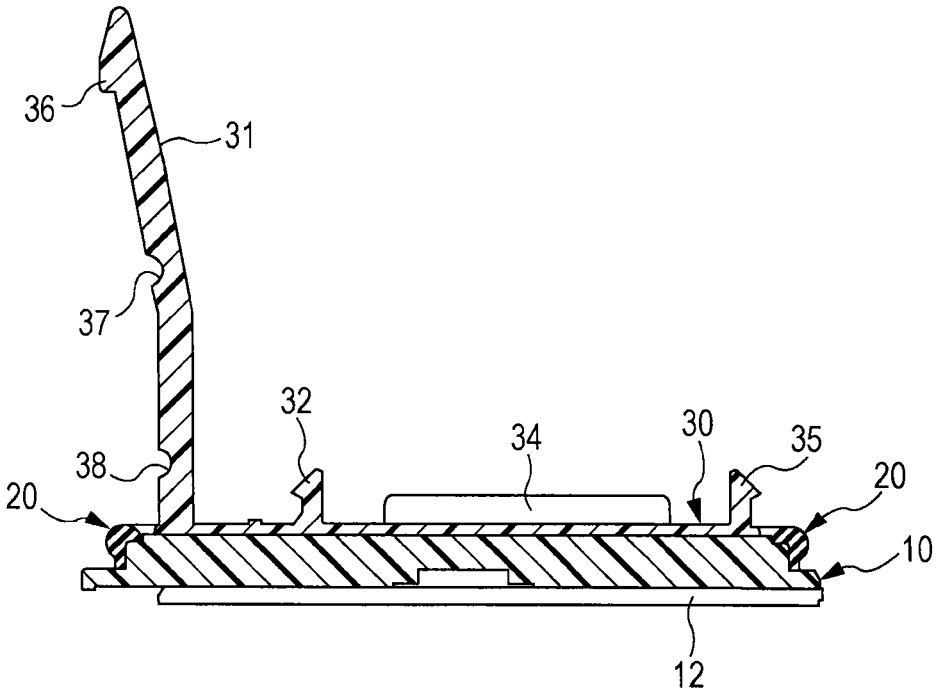
Figure 2C:
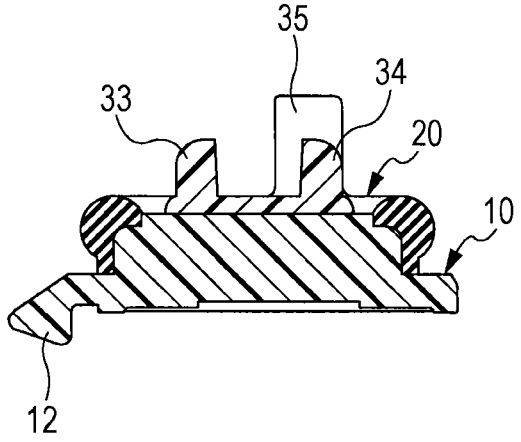
Figure 2D:
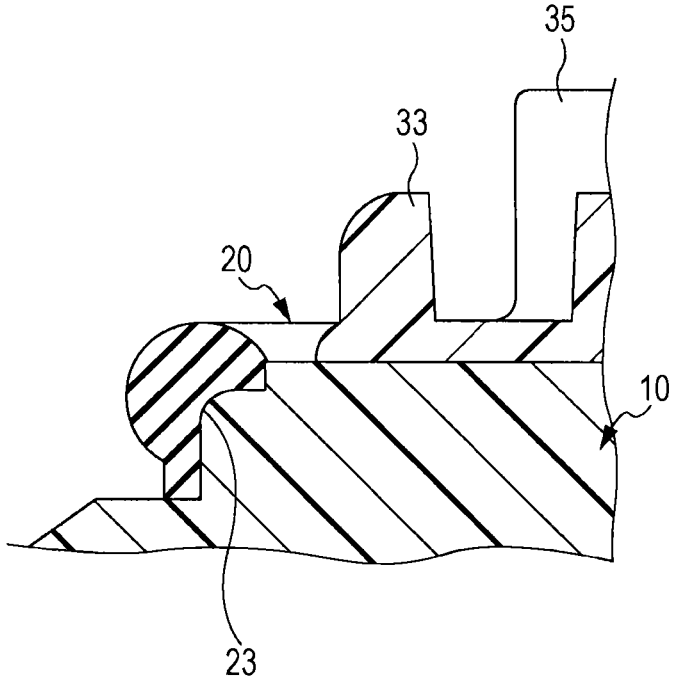
Figure 3A:
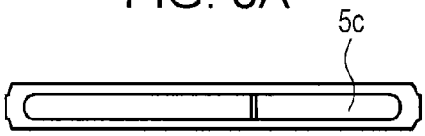
FIGS. 3A, 3B, 3C, and 3D are diagrams showing four sides of a casing of an electronic device that uses the connector cap.
Figure 3B:
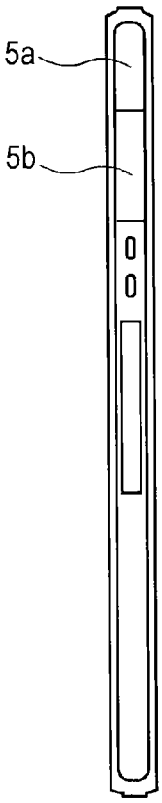
Figure 3C:
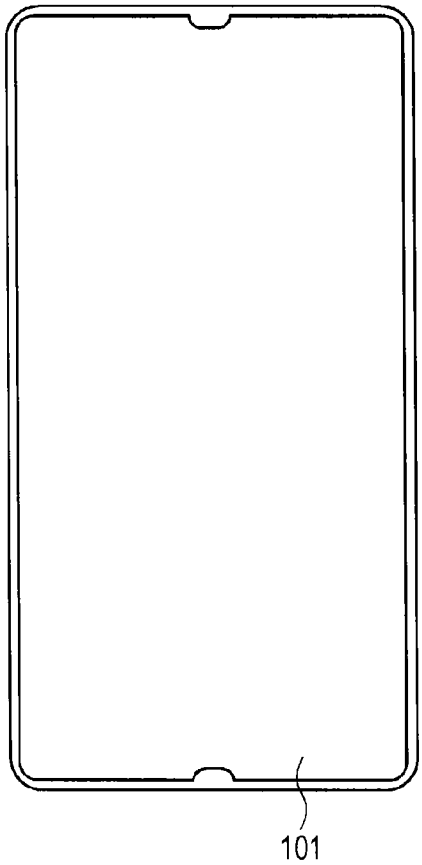
Figure 3D:
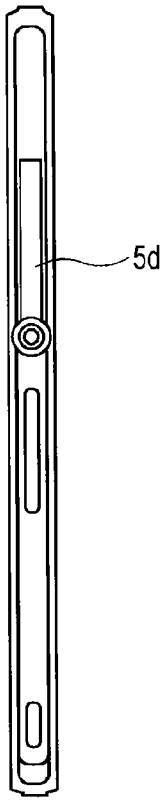

Hereinbelow, embodiments will be described in detail.

Referring to FIGS. 2(*a*) to 2(*d*), the structure of a connector cap (connector cover) according to this embodiment will be described. A connector cap 5 is a part that fits to a connector opening provided in a casing of an electronic device in a watertight manner. FIG. 2(*a*) is a perspective view showing the exterior of the connector cap 5. FIG. 2(*b*) is a cross-sectional view of the connector cap 5, taken along line B-B. FIG. 2(*c*) is a cross-sectional view of the connector cap 5, taken along line C-C. FIG. 2(*d*) is an enlarged cross-sectional view of a relevant part in FIG. 2(*c*).

The connector cap 5 includes a base 10, a sealing member 20 formed of an elastic member into a ring-like shape on the periphery of this base 10, and a connector facing portion 30 formed integrally with the base 10. A joint surface 23 of the sealing member 20 to be joined to the base 10 is a portion corresponding to a shoulder portion of the base 10. The connector facing portion 30 includes a flexible member 31 having a tongue-like shape and extending toward the inside of the casing, claw portions 32 and 35, and ribs 33 and 34. The flexible member 31 is a member constituting a so-called hinge portion and has, at a free end thereof, a hook portion 36 that is engageable with an engaging portion (115*a* to 115*d* described below) of the casing when the connector cap 5 is removed from and pulled out of the connector opening. The flexible member 31 has, at an intermediate portion thereof, grooves 37 and 38 extending in a direction perpendicular to the longitudinal direction. The grooves 37 and 38 serve to increase the flexibility of the flexible member 31, but they are not essential elements.

The claw portions 32 and 35 serve to ensure the connector cap 5 being in tight contact with the connector opening and being engaged with the casing when the connector cap 5 is fitted to the connector opening. Note that, however, because the sealing member 20 is in tight contact with the connector opening, and this state is maintained due to friction, the claw portions 32 and 35 are not essential elements. The ribs 33 and 34 are elements that cover and protect the connector openings, and whether or not the ribs 33 and 34 are necessary, the shapes of the ribs 33 and 34, etc. may change depending on the type of the connectors. The flexible member 31 and the claw portions 32 and 35 are provided in the inner area enclosed by the ring-like sealing member. Due to this configuration, for the connector cap 5, there is no need to provide an opening in the casing other than the connector opening. Furthermore, waterproofing measures for other openings become unnecessary.

A handle 12 is protruding at a longitudinal side edge of the base 10. The handle 12 is a portion where a user holds when the user removes the connector cap 5 fitted to the casing.

In this embodiment, the base 10 is formed of a thermoplastic resin (for example, polycarbonate: PC). Furthermore, the connector facing portion 30 is formed of a thermoplastic elastic material, for example, thermoplastic elastomer (TPE: thermoplastic elastomer) or thermoplastic polyurethane resin (TPU: thermoplastic polyurethane). The base 10 and the connector facing portion 30 are integrally formed of these two materials and constitute a cover part.

FIGS. 3(*a*) to 3(*d*) show four sides of a casing 101 of the electronic device 100 that uses the connector cap. FIG. 3(*a*) is a top view, FIG. 3(*b*) is a left side view, FIG. 3(*c*) is a front view, and FIG. 3(*d*) is a right side view. In this example, the left side view shows USB and SD connector caps 5*a* and 5*b*, respectively, the top view shows an audio jack connector cap 5*c*, and the right side view shows a SIM connector cap 5*d*.

Figure 4:
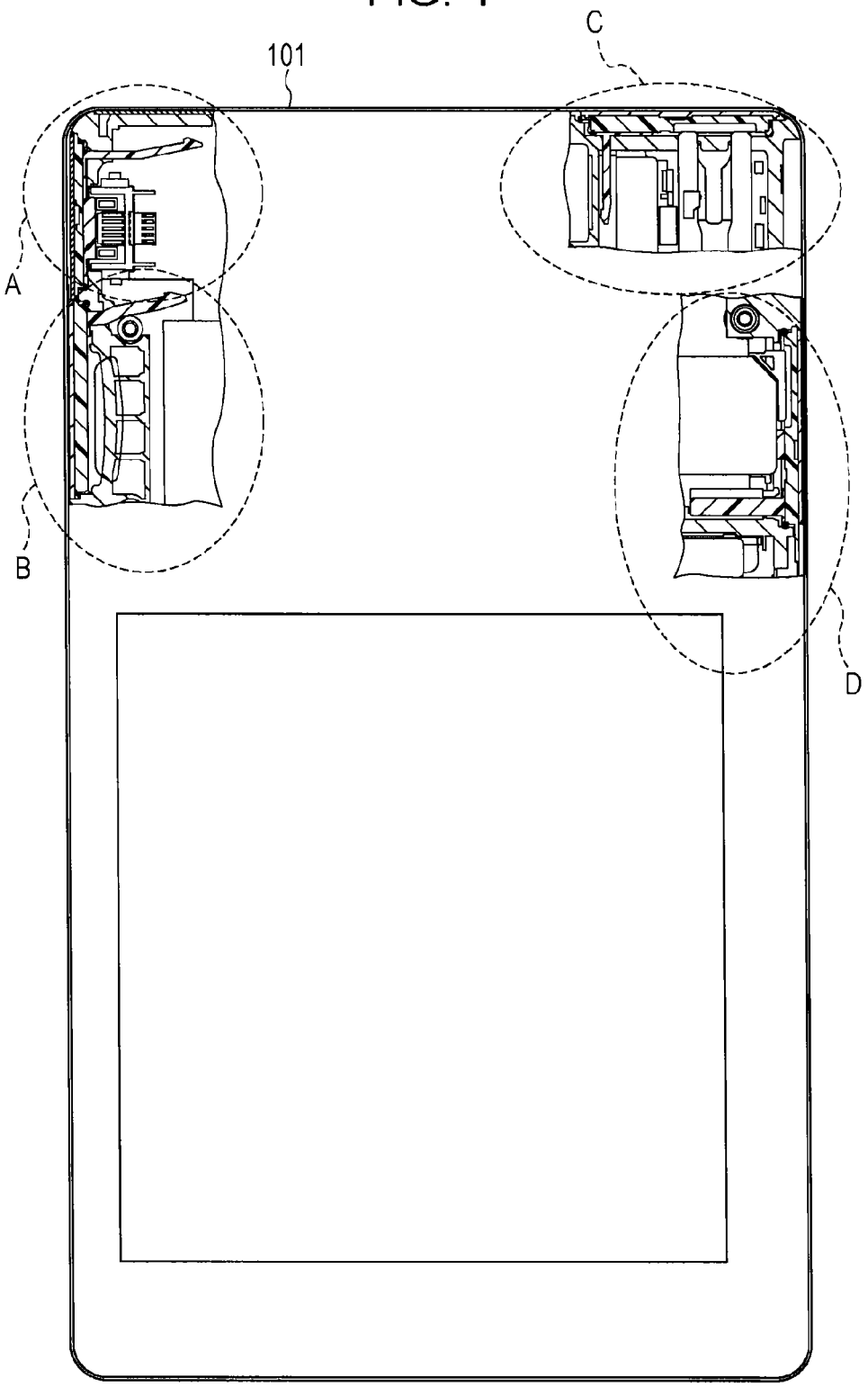
FIG. 4 is a diagram showing an arrangement of connector caps inside the casing, corresponding to a front view in FIG. 3C.

FIG. 4 is a diagram showing an arrangement of the connector caps 5*a* to 5*d* inside the casing 101, corresponding to the front view in FIG. 3(*c*). The connector caps 5*a* to 5*d* are disposed in areas A to D of the casing 101, respectively.

Figure 5A:
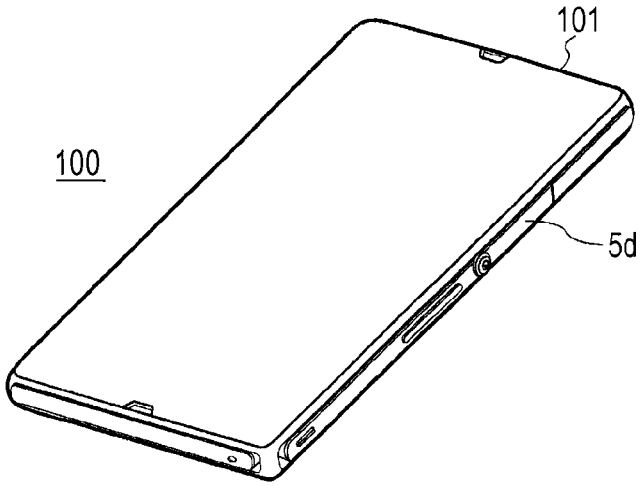
FIGS. 5A, 5B, and 5C are perspective views of the casing, as viewed from three different angles.
Figure 5B:
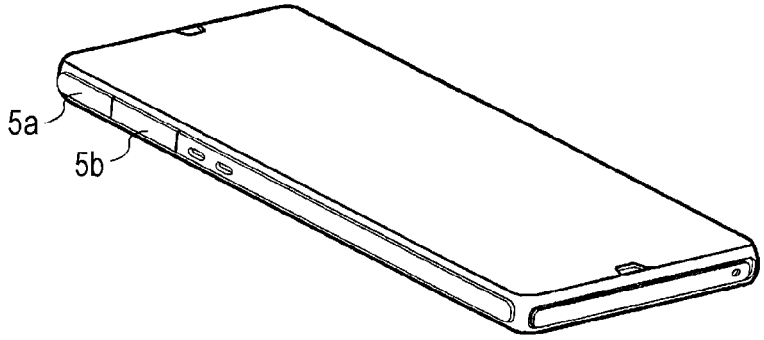
Figure 5C:
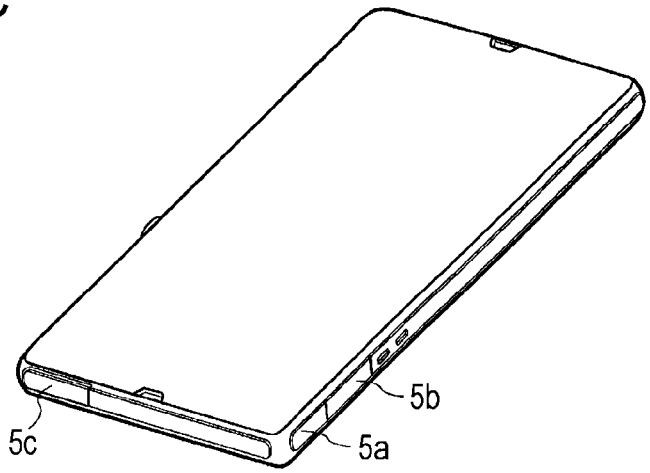
Figure 6A:
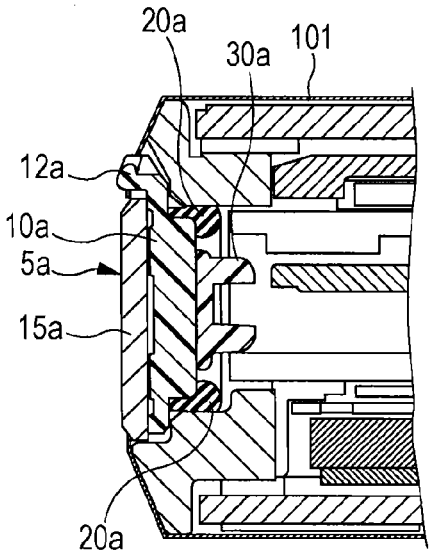
FIGS. 6A, 6B, 6C, and 6D are cross-sectional views of the casing and a USB connector cap.
Figure 6B:
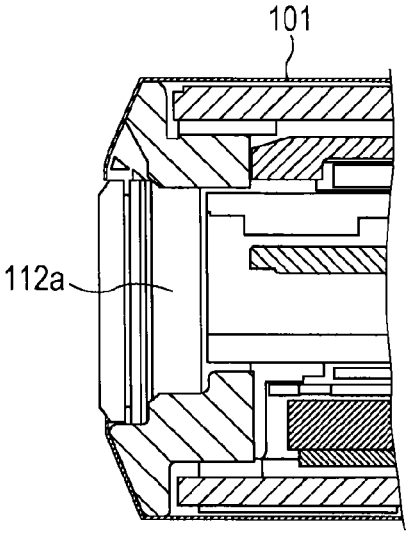
Figure 6C:
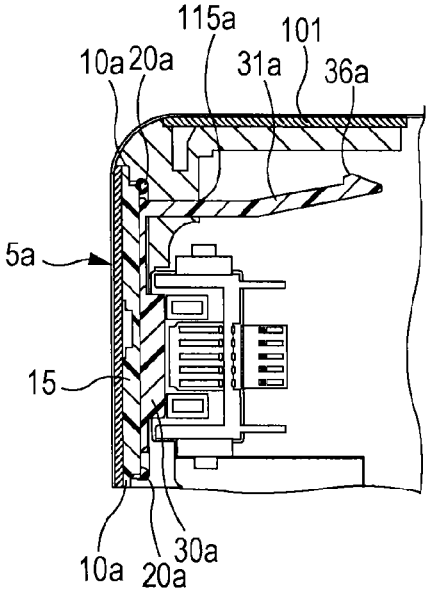
Figure 6D:
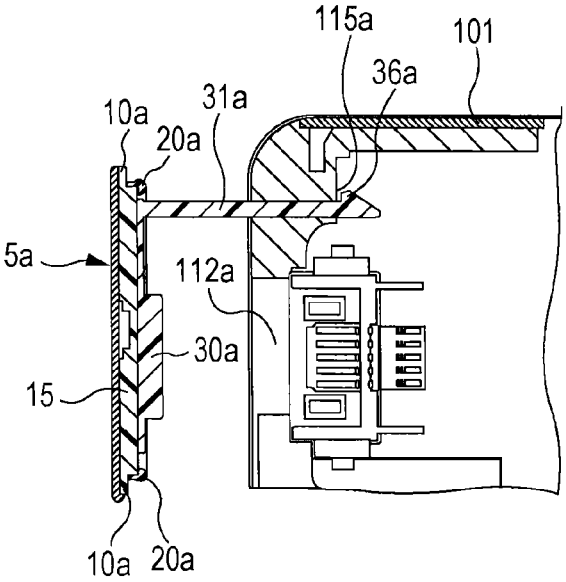
Figure 7A:
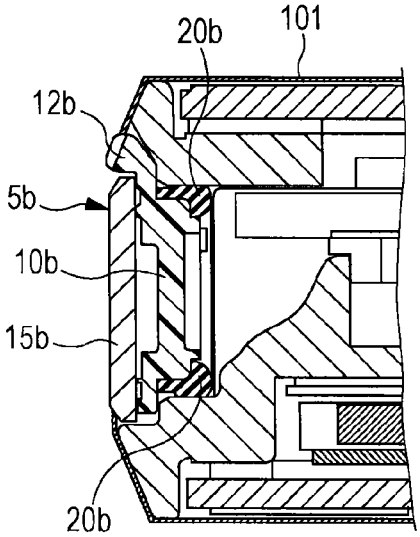
FIGS. 7A, 7B, 7C, and 7D are cross-sectional views of the casing and an SD connector cap.
Figure 7B:
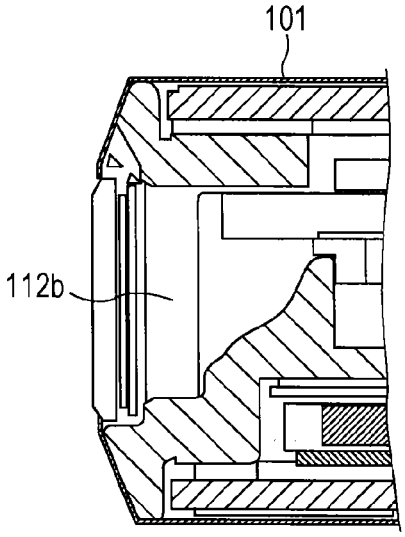
Figure 7C:
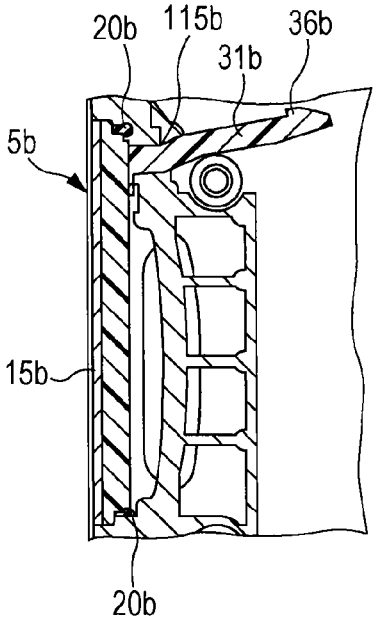
Figure 7D:
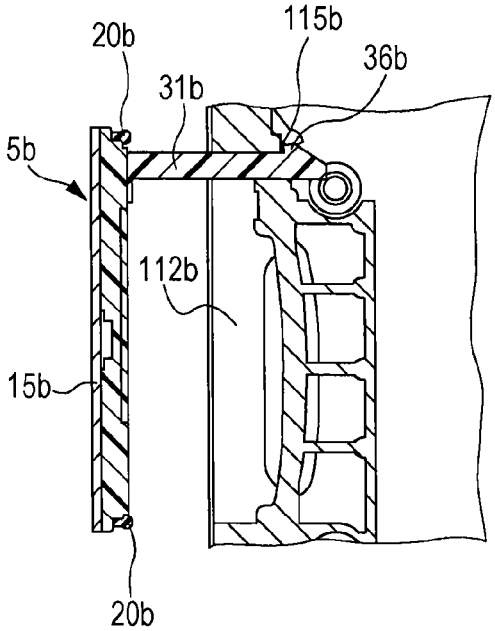
Figure 8A:
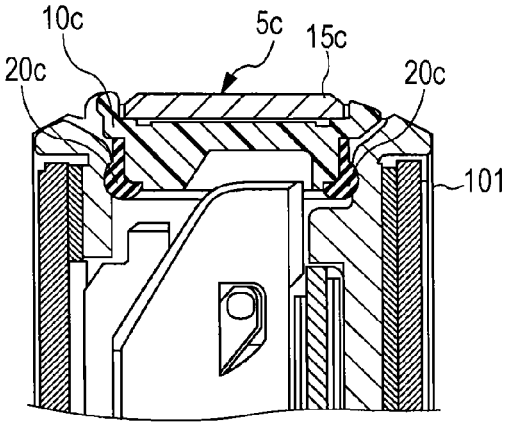
FIGS. 8A, 8B, 8C, and 8D are cross-sectional views of the casing and an audio jack connector cap.
Figure 8B:
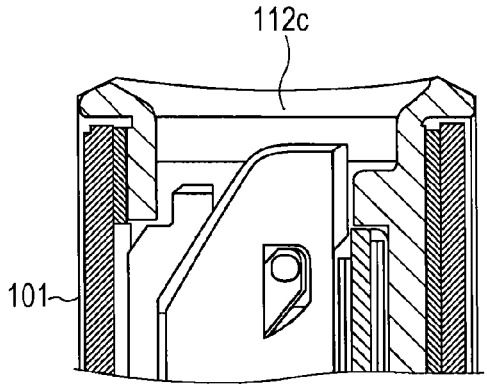
Figure 8C:
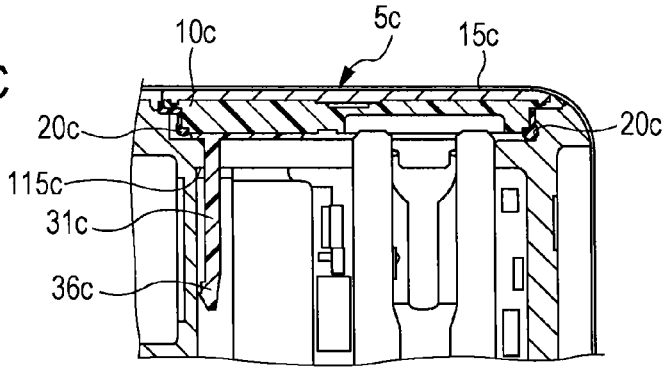
Figure 8D:
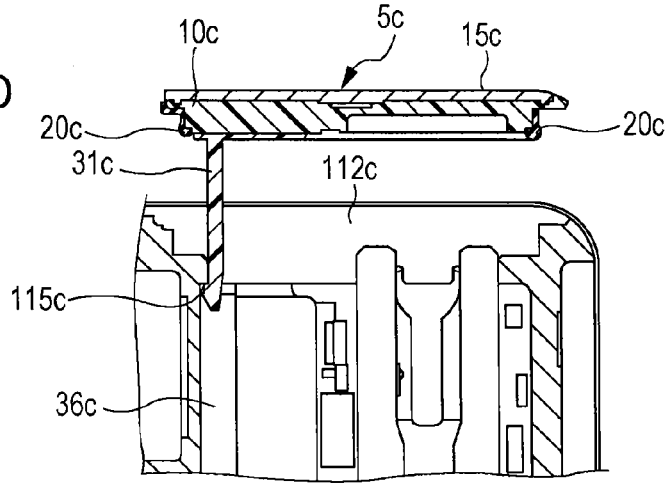
Figure 9A:
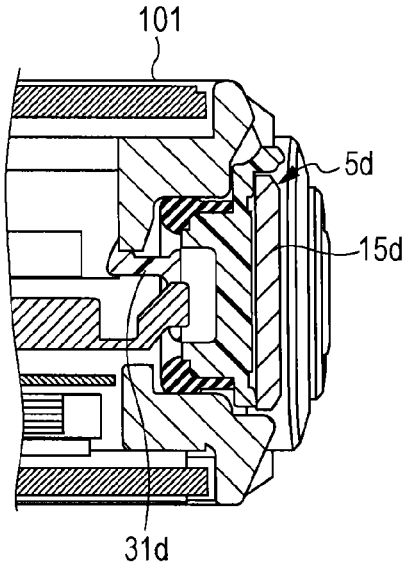
FIGS. 9A, 9B, 9C, and 9D are cross-sectional views of the casing and a SIM connector cap.
Figure 9B:
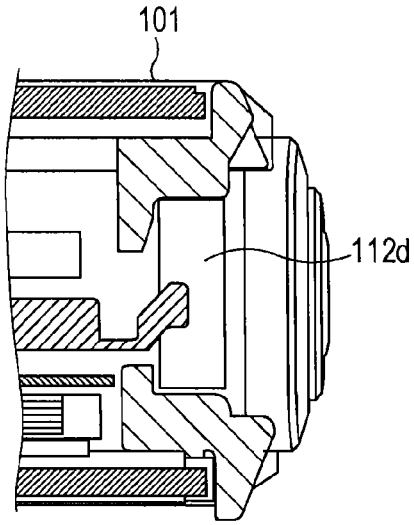
Figure 9C:
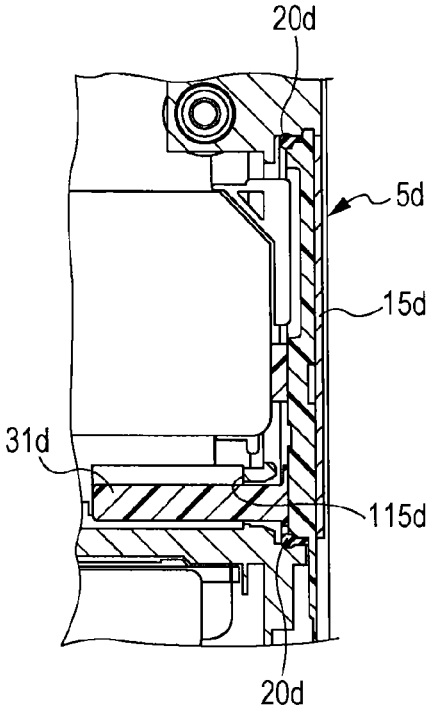
Figure 9D:
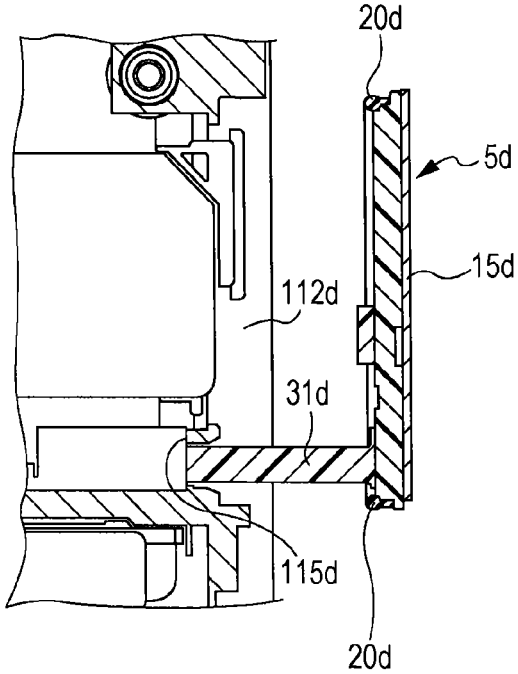

FIGS. 5(*a*) to 5(*c*) are perspective views of the casing 101, as viewed from three different angles. FIG. 5(*a*) shows the connector cap 5*d*. FIG. 5(*b*) shows the connector caps 5*a* and 5*b*. And FIG. 5(*c*) shows the connector caps 5*a*, 5*b*, and 5*c*.

FIGS. 6(*a*) to 6(*d*) are cross-sectional views of the casing 101 and the USB connector cap 5*a*. FIG. 6(*a*) is a partially cut-out cross-sectional view of the casing 101 to which the connector cap 5*a* is fitted, taken in a direction perpendicular to the longitudinal direction of the connector cap 5*a*. Although this connector cap 5*a* has a decoration plate 15*a* joined to an outer surface of a base 10*a*, the decoration plate 15*a* is not an essential element. FIG. 6(*b*) is a cross-sectional view showing a state in which the connector cap 5*a* in FIG. 6(*a*) is removed from the casing 101. FIG. 6(*b*) shows a connector opening 112*a*. FIG. 6(*c*) is a partially cut-out cross-sectional view of the casing 101 to which the connector cap 5*a* is fitted, taken in the longitudinal direction. FIG. 6(*d*) is a cross-sectional view showing a state in which the connector cap 5*a* is pulled out of the casing 101. A flexible member 31*a* in a pulled-out state is prevented from being pulled out any further due to a hook portion 36*a* thereof being engaged with the engaging portion 115*a* of the casing.

FIGS. 7(*a*) to 7(*d*) are cross-sectional views of the casing 101 and the SD connector cap 5*b*. FIG. 7(*a*) is a partially cut-out cross-sectional view of the casing 101 to which the connector cap 5*b* is fitted, taken in a direction perpendicular to the longitudinal direction of the connector cap 5*b*. Although this connector cap 5*b* has a decoration plate 15*b* joined to an outer surface of a base 10*b*, the decoration plate 15*b* is not an essential element. FIG. 7(*b*) is a cross-sectional view showing a state in which the connector cap 5*b* in FIG. 7(*a*) is removed from the casing 101. FIG. 7(*b*) shows a connector opening 112*b*. FIG. 7(*c*) is a partially cut-out cross-sectional view of the casing 101 to which the connector cap 5*b* is fitted, taken in the longitudinal direction. FIG. 7(*d*) is a cross-sectional view showing a state in which the connector cap 5*b* is pulled out of the casing 101. A flexible member 31*b* in a pulled-out state is prevented from being pulled out any further due to a hook portion 36*b* thereof being engaged with the engaging portion 115*b* of the casing.

FIGS. 8(*a*) to 8(*d*) are cross-sectional views of the casing 101 and the audio jack connector cap 5*c*. FIG. 8(*a*) is a partially cut-out cross-sectional view of the casing 101 to which the connector cap 5*c* is fitted, taken in a direction perpendicular to the longitudinal direction of the connector cap 5*c*. Although this connector cap 5*c* has a decoration plate 15*c* joined to an outer surface of a base 10*c*, the decoration plate 15*c* is not an essential element. FIG. 8(*b*) is a cross-sectional view showing a state in which the connector cap 5*c* in FIG. 8(*a*) is removed from the casing 101. FIG. 8(*b*) shows a connector opening 112*c*. FIG. 8(*c*) is a partially cut-out cross-sectional view of the casing 101 to which the connector cap 5*c* is fitted, taken in the longitudinal direction. FIG. 8(*d*) is a cross-sectional view showing a state in which the connector cap 5*c* is pulled out of the casing 101. A flexible member 31*c* in a pulled-out state is prevented from being pulled out any further due to a hook portion 36*c* thereof being engaged with the engaging portion 115*c* of the casing.

FIGS. 9(*a*) to 9(*d*) are cross-sectional views of the casing 101 and the SIM connector cap 5*d*. FIG. 9(*a*) is a partially cut-out cross-sectional view of the casing 101 to which the connector cap 5*d* is fitted, taken in a direction perpendicular to the longitudinal direction of the connector cap 5*d*. Although this connector cap 5*d* has a decoration plate 15*d* joined to an outer surface of a base 10*d*, the decoration plate 15*d* is not an essential element. FIG. 9(*b*) is a cross-sectional view showing a state in which the connector cap 5*d* in FIG. 9(*a*) is removed from the casing 101. FIG. 9(*b*) shows a connector opening 112*d*. FIG. 9(*c*) is a partially cut-out cross-sectional view of the casing 101 to which the connector cap 5*d* is fitted, taken in the longitudinal direction. FIG. 9(*d*) is a cross-sectional view showing a state in which the connector cap 5*d* is pulled out of the casing 101. A flexible member 31*d* in a pulled-out state is prevented from being pulled out any further due to a hook portion 36*d* thereof being engaged with the engaging portion 115*d* of the casing. Note that the direction in which the hook portion 36*d* of the flexible member 31*d* of the connector cap 5*d* protrudes differs from those of the other flexible members. The direction in which the hook portion protrudes is not specifically limited.

Next, the joining strength between the sealing member 20 and the base 10 will be described.

Figure 10A:
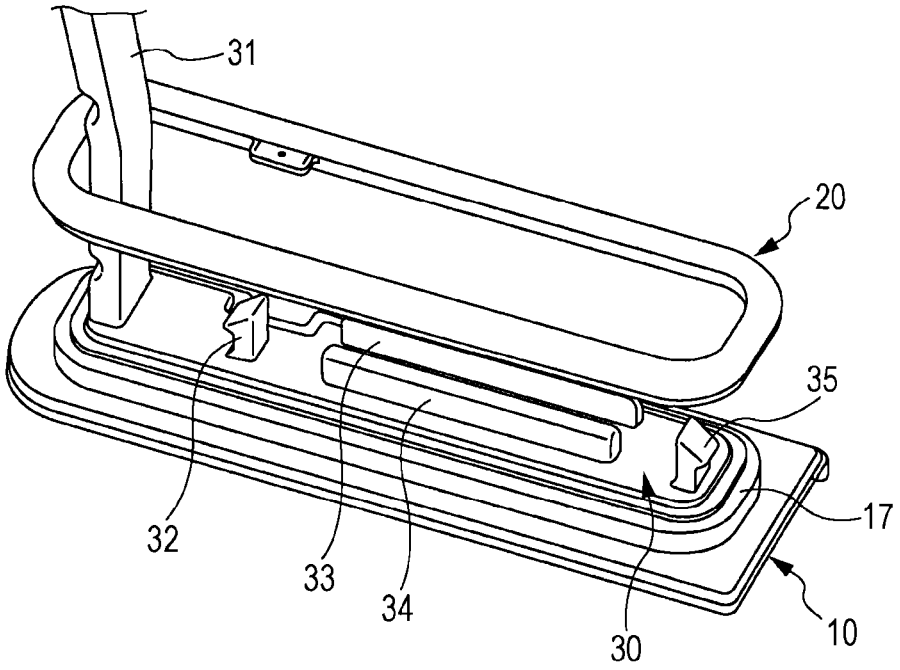
FIGS. 10A and 10B are partially cut-away exploded perspective views of a sealing member of the connector cap separated from a cover part, as viewed from different angles.
Figure 10B:
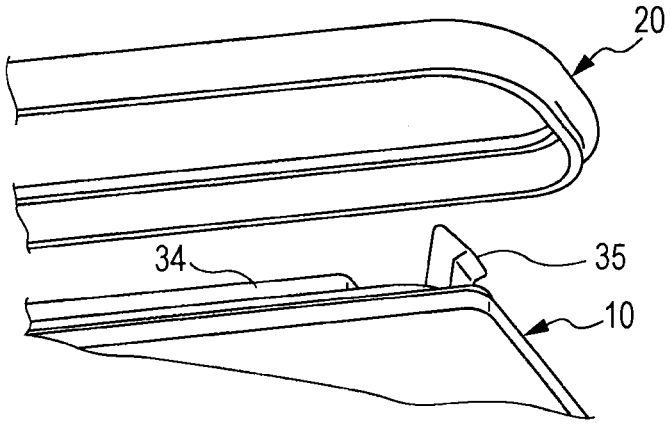
Figure 11A:
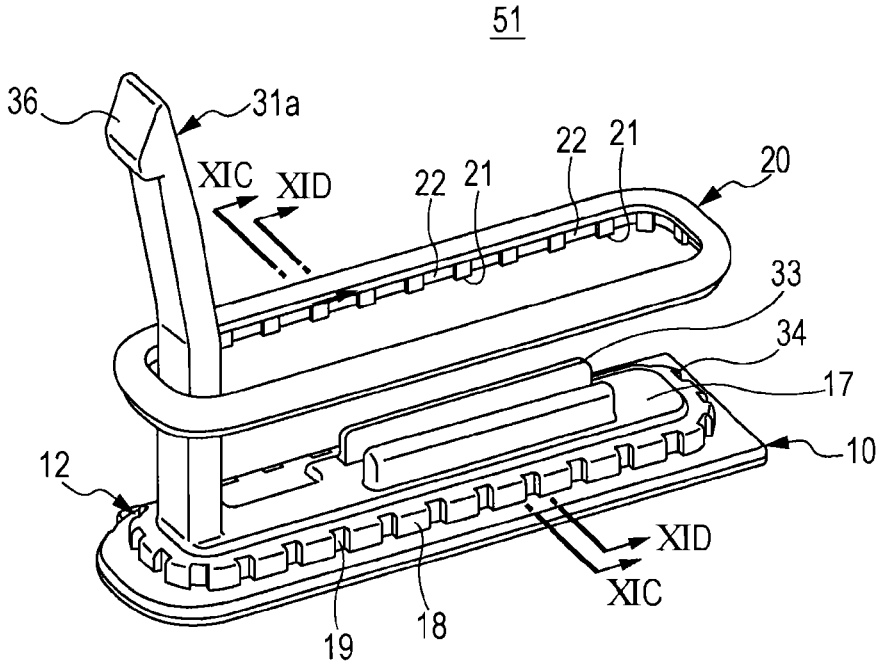
FIGS. 11A, 11B, 11C, and 11D are diagrams showing a configuration example of a connector cap having a joint surface provided with concaves and convexes.
Figure 11B:
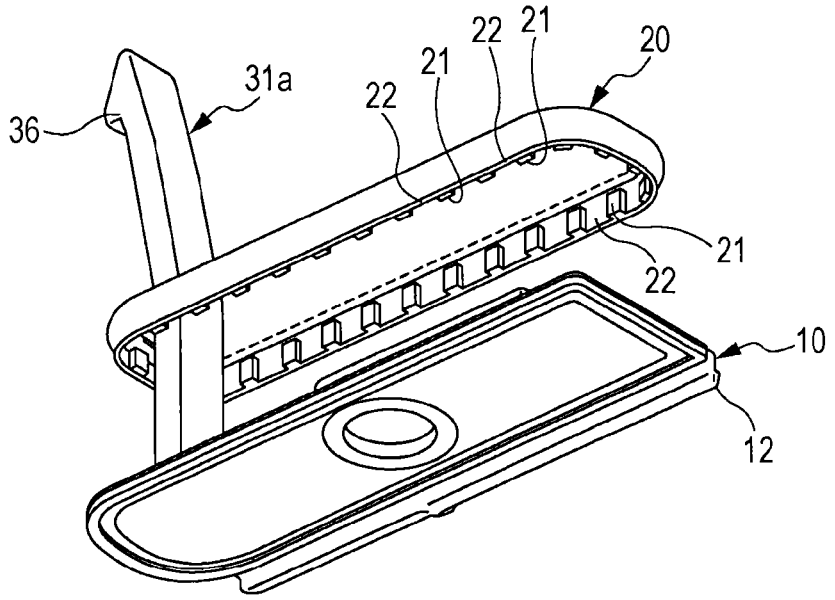
Figure 11C:
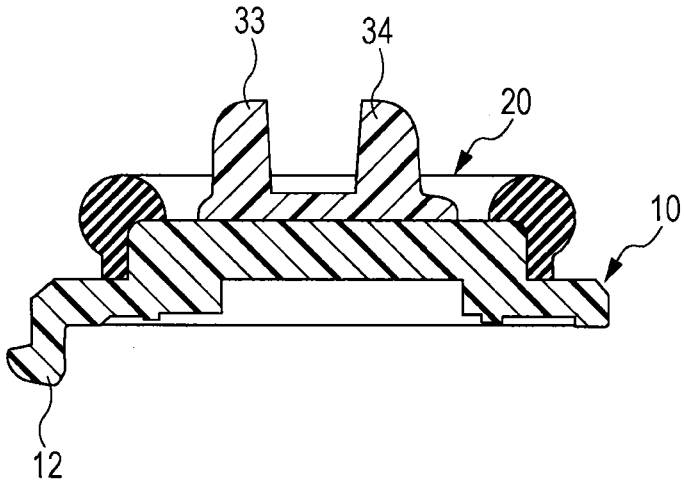
Figure 11D:
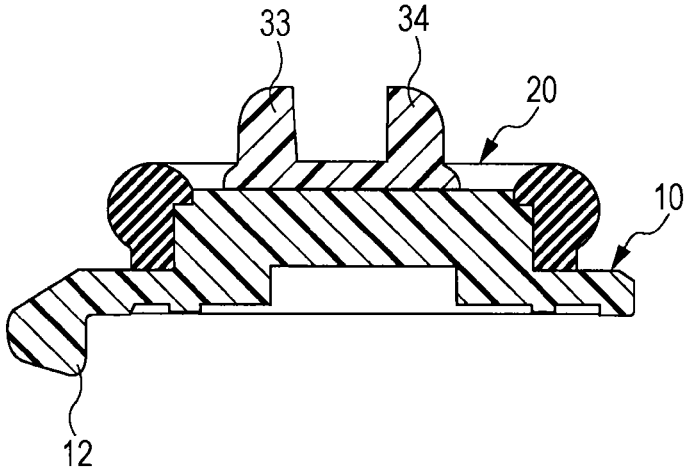

FIGS. 10(*a*) and 10(*b*) are partially cut-away exploded perspective views of the sealing member 20 of the connector cap 5 separated from the cover part, as viewed from different angles.

In this embodiment, the sealing member 20 is joined to a shoulder portion of a seating portion 17, which is elevated in a trapezoidal shape, of the base 10. The sealing member 20 is repeatedly subjected to friction with respect to the connector opening when the connector cap 5 is fitted to and removed from the casing. Therefore, if the joining force between the sealing member 20 and the base 10 is insufficient, an inconvenience that the sealing member 20 is separated from the base 10 at the joint surface 23 may occur. This problem becomes more evident when the area of the joint surface between the sealing member 20 and the base 10 is smaller.

In this embodiment, the sealing member 20 composed of an elastic material (for example, silicone rubber) is formed integrally with the base 10 by liquid silicone injection molding (LIM). To increase the bonding strength of the sealing member 20, conventionally, it has been necessary to ensure a large joining area between the sealing member and the base. In the technique disclosed in PTL 1, a ring-like raised portion is formed on a base, and a waterproof member (corresponding to the sealing member) composed of rubber or elastomer is formed so as to cover the raised portion, thereby increasing the joining area therebetween.

A second embodiment intends to provide a structure of the connector cap 5 that can maintain the joining strength between the sealing member 20 and the base 10 (see FIG. 2(*d*)) in a good condition for a long time, even if the area of the joint surface 23 therebetween is small.

In order for that, when the sealing member 20 is formed integrally with the base 10, concaves and convexes are formed on the joint surface 23 of the base 10 with respect to the sealing member 20 so as to increase the strength of joining (bonding strength) of the sealing member 20 with respect to the base 10. Specific aspects of how to form concaves and convexes on the joint surface include the following.

(1) Subjecting the joint surface (bonding surface) to graining or blasting to increase the adhesion. Graining is finishing in which a relatively fine concave-and-convex pattern, such as satin, wood, or fabric texture, is formed on the surface of a mold for the base 10, thereby forming the corresponding concave-and-convex pattern on the joint surface 23 of the molded base 10. Blasting is finishing performed as an after treatment, in which a relatively fine concave-and-convex pattern, such as satin, wood, or fabric texture, is formed on the joint surface 23 after the base 10 is molded.

(2) Providing relatively large concaves and convexes on the joint surface to increase the surface area.

FIGS. 11(*a*) to 11(*d*) show a configuration example of a connector cap 51 having a joint surface provided with relatively large concaves and convexes. FIG. 11(*a*) is an exploded perspective view of the connector cap 51. FIG. 11(*b*) is an exploded perspective view of the connector cap 51, viewed from another angle. FIGS. 11(*c*) and 11(*d*) are cross-sectional views, taken along lines C-C and D-D in FIG. 11(*a*), respectively, of the connector cap 51 in a state in which the base 10 and the sealing member 20 are connected. Convex portions 21 and concave portions 22 are alternately formed on the periphery of the seating portion 17 of the base 10. That is, convex portions 18 formed on the periphery of the seating portion 17 fit into the concave portions 22 formed in the inner side of the ring-like sealing member 20, and the convex portions 21 formed on the inner side of the ring-like sealing member 20 fit into concave portions 19 formed in the periphery of the seating portion 17. Note that the claw portions 32 and 35 shown in FIG. 2(*a*) are removed from the connector cap 51. In this case, the area of the side surface over which the sealing member 20 is in contact with the base 10 increases, and sufficient friction between the base 10 and the sealing member 20 can be expected.

Although the illustrated flexible member 31*a* of the connector cap 51 has no grooves 37 and 38, the grooves 37 and 38 may be provided. Although the illustrated configuration has no claw portions 32 and 35, the claw portions 32 and 35 may be provided.

(3) Forming ribs on the joint surface to further increase the adhesion.

Figure 12A:
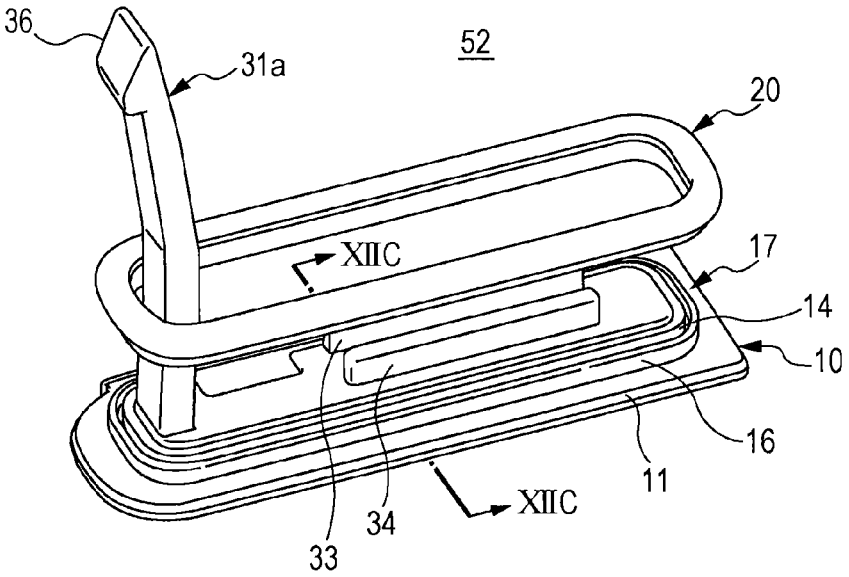
FIGS. 12A, 12B, and 12C are diagrams showing a configuration example of a connector cap having a joint surface provided with a continuous rib formed over the entire circumference of the ring-like sealing member.
Figure 12B:
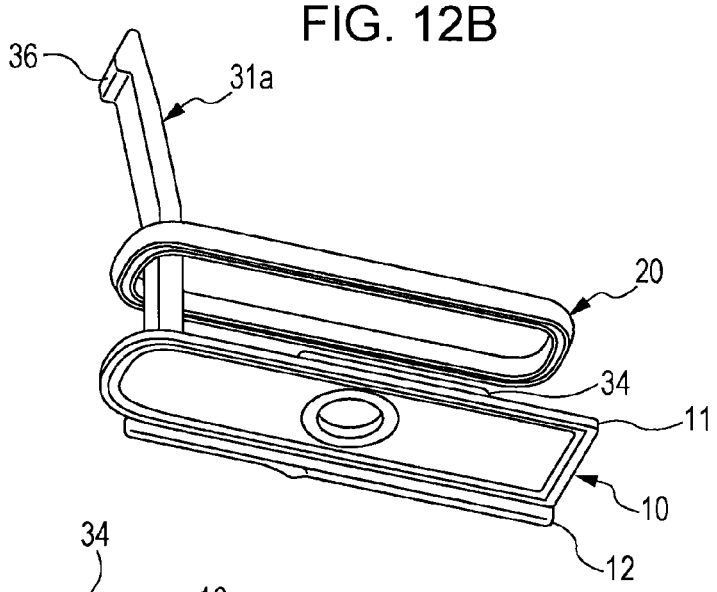
Figure 12C:
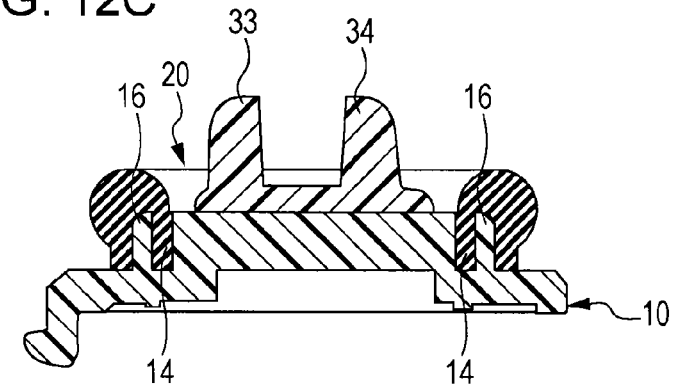
Figure 13A:
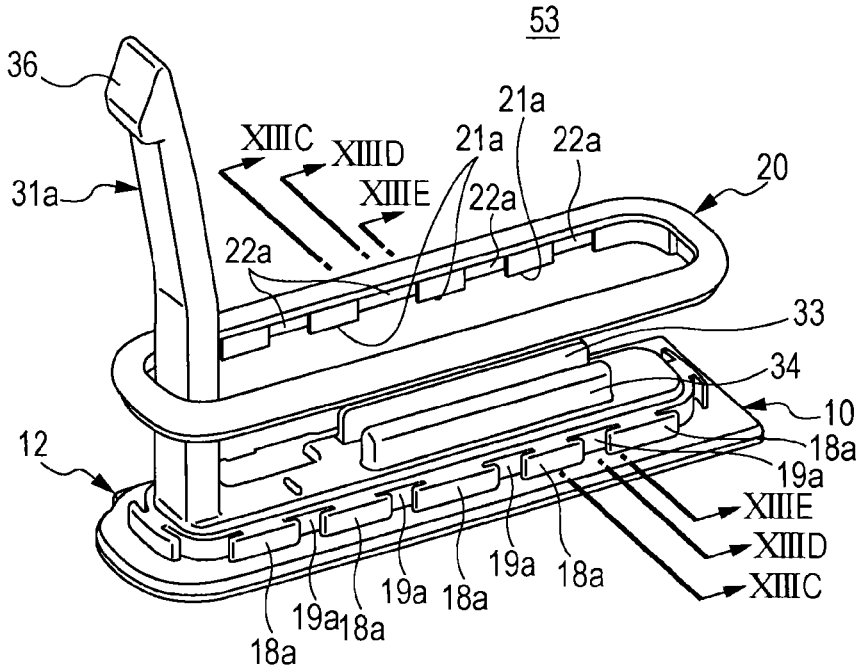
FIGS. 13A, 13B, 13C, 13D and 13E are diagrams showing a configuration example of a connector cap having a joint surface provided with ribs formed discontinuously over the entire circumference of the ring-like sealing member.
Figure 13B:
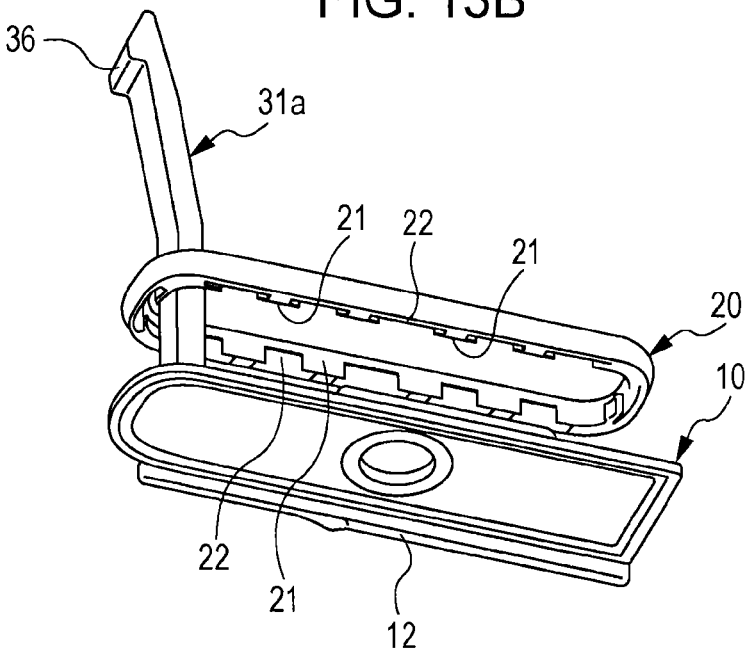
Figure 13C:
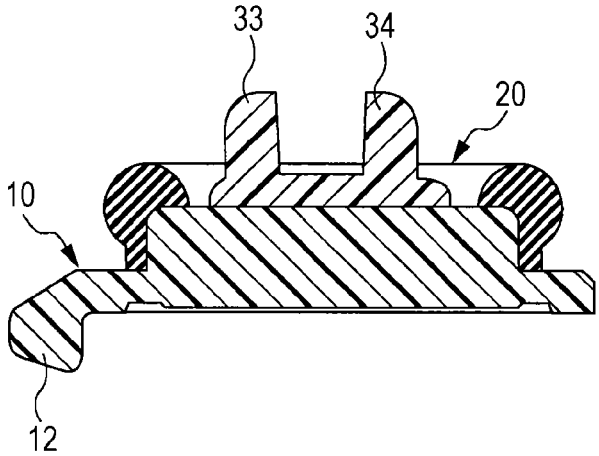
Figure 13D:
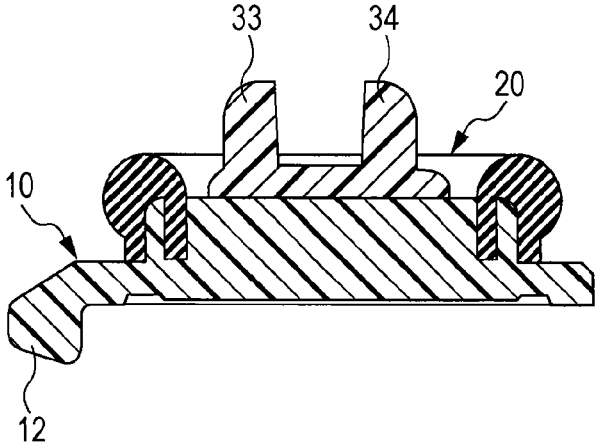
Figure 13E:
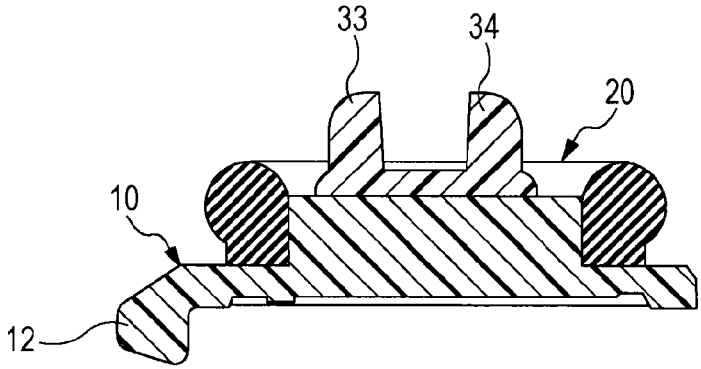
Figure 14A:
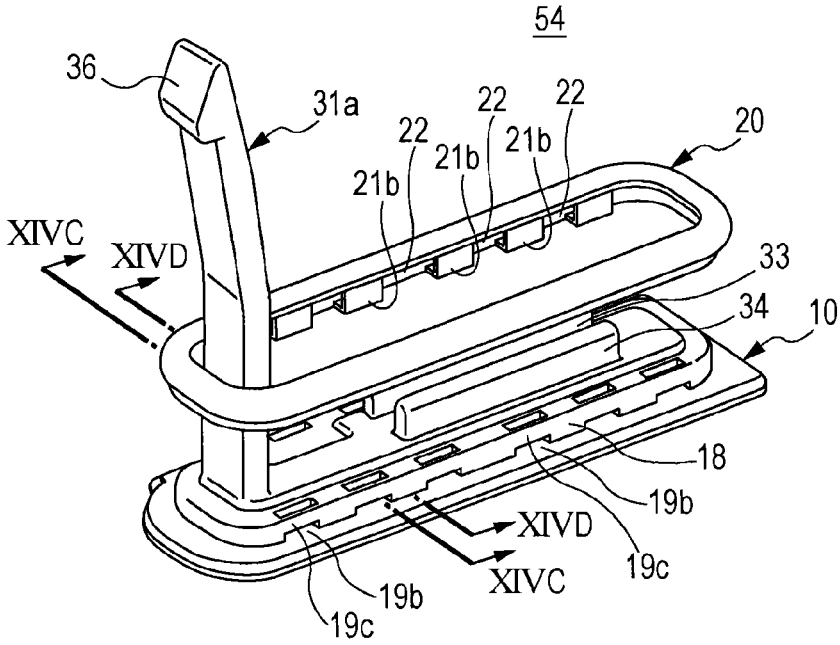
FIGS. 14A, 14B, 14C, and 14D are diagrams showing a configuration example of a connector cap having a structure in which a portion of the sealing member wraps around and holds a portion of a base at the joint surface discontinuously over the entire circumference of the ring-like sealing member.
Figure 14B:
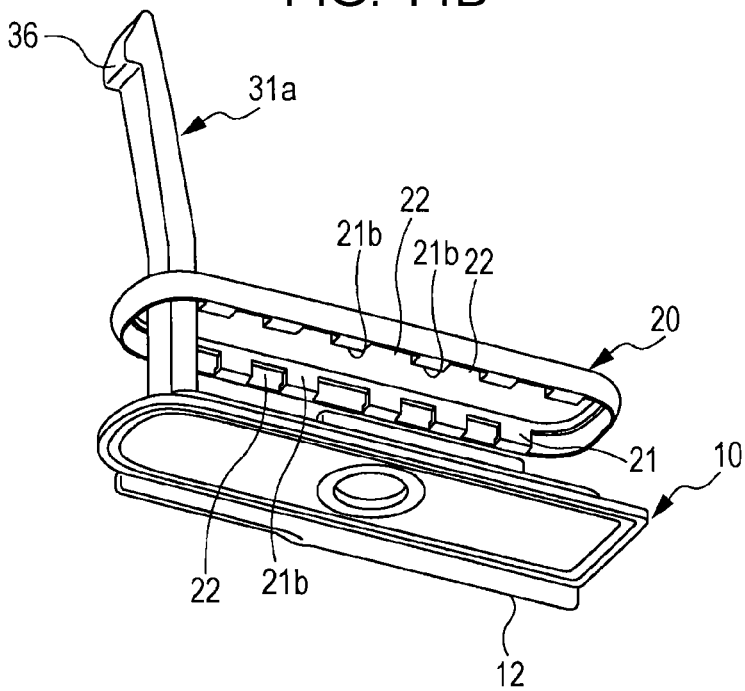
Figure 14C:
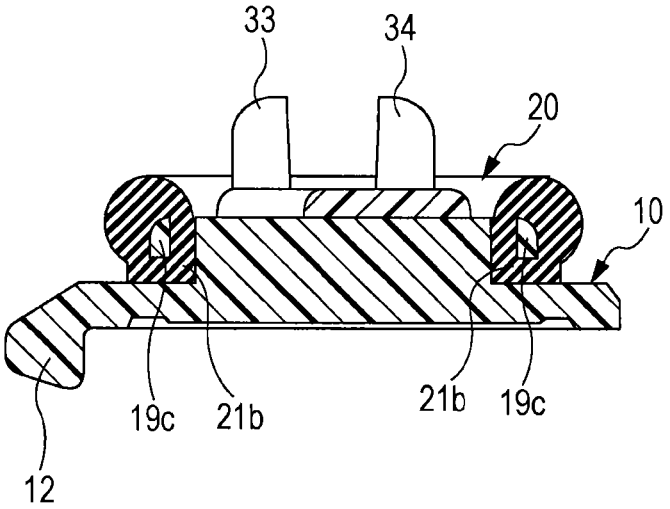
Figure 14D:
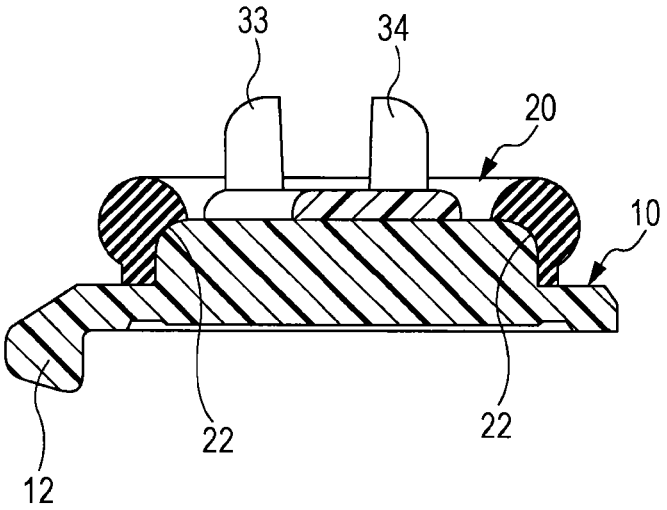

FIGS. 12(*a*) to 12(*c*) show a configuration example of a connector cap 52 having a joint surface provided with a continuous rib over the entire circumference of the ring-like sealing member 20. FIG. 12(*a*) is an exploded perspective view of the connector cap 52. FIG. 12(*b*) is an exploded perspective view of the connector cap 52, viewed from another angle. FIG. 12(*c*) is a cross-sectional view of the connector cap 52 in a state in which the base 10 and the sealing member 20 are connected, taken along line C-C in FIG. 12(*a*). In this connector cap 52, a ring-like rib 16 is formed by providing a ring-like groove 14 on the inner side of the periphery of the seating portion 17 so as to be parallel to the periphery. As clearly illustrated in FIG. 12(*c*), the sealing member 20 is bonded to the shoulder portion of the seating portion 17 so as to wrap around the rib 16. In this case, the sealing member 20 is in contact with the base 10 at three side surfaces, that is, the side walls of the groove 14 formed in the base 10 and the outer wall of the shoulder portion of the seating portion 17 (i.e., the outer wall of the rib 16). Thus, sufficient friction between the base 10 and the sealing member 20 can be expected.

Although this aspect, in which a rib is formed on the base 10, is similar to the configuration disclosed in PTL 1, the raised portion 113 therein needs to have a certain width to maintain predetermined structural strength, and in order to ensure the size of the area on the inner side thereof, the size of the ring-like raised portion inevitably increases. In contrast, in the connector cap 52 shown in FIG. 12, the width of the projection 16 is small owing to the presence of the side walls of the groove 14.

(4) Providing ribs discontinuously on the joint surface to further increase the adhesion.

FIGS. 13(*a*) to 13(*c*) show a configuration example of a connector cap 53 having a joint surface provided with ribs formed discontinuously over the entire circumference of the ring-like sealing member 20. FIG. 13(*a*) is an exploded perspective view of the connector cap 53. FIG. 13(*b*) is an exploded perspective view of the connector cap 53, viewed from another angle. FIGS. 13(*c*), 13(*d*), and 13(*e*) are cross-sectional views of the connector cap 53 in a state in which the base 10 and the sealing member 20 are connected, taken along lines C-C, D-D, and E-E in FIG. 13(*a*), respectively. In this connector cap 53, T-shaped convex portions 18*a* protruding in a direction parallel to the surface of the seating portion 17 are formed in a repeated manner on the periphery of the seating portion 17. Between adjacent convex portions 18*a* are formed inverted T-shaped concave portions 19*a*. As can be seen from FIGS. 13(*c*) to 13(*e*), the sealing member 20 bonded to the shoulder portion of the seating portion 17 is bonded such that the cross sections shown in FIGS. 11(*c*), 12(*c*), and 11(*d*) are successively repeated over the entire periphery of the shoulder portion of the seating portion 17. In other words, convex portions 21*a* and concave portions 22*a* corresponding to the convex portions 18*a* and the concave portions 19*a*, respectively, of the seating portion 17 are alternately formed on the inner circumferential side of the sealing member 20. Thus, sufficient friction between the base 10 and the sealing member 20 can be expected.

(5) With a structure in which a portion of the sealing member 20 wraps around and holds a portion of the base 10 at the joint surface, the adhesion strength is mechanically increased.

FIGS. 14(*a*) to 14(*d*) show a configuration example of a connector cap 54 having a structure in which a portion of the sealing member 20 wraps around and holds a portion of the base 10 at the joint surface discontinuously over the entire circumference of the ring-like sealing member 20. FIG. 14(*a*) is an exploded perspective view of the connector cap 54. FIG. 14(*b*) is an exploded perspective view of the connector cap 54, viewed from another angle. FIG. 14(*c*) is a cross-sectional view, taken along lines C-C and D-D in FIG. 14(*a*), of the connector cap 54 in a state in which the base 10 and the sealing member 20 are joined. In this connector cap 54, the convex portions 18 and concave portions 19*b* are formed alternately along the periphery of the seating portion 17. Bridges 19*c* between adjacent convex portions 18 are provided at the concave portions 19*b*. As a result, similarly, convex portions 21*b* and the concave portions 22 are alternately formed on the sealing member 20 bonded to the shoulder portion of the seating portion 17. As shown in FIG. 14(*c*), the convex portions 21*b* accommodate the bridges 19*c* therein. That is, the sealing member 20 is bonded to the base 10 in such a manner that a portion of the sealing member 20 wraps around and holds a portion of the base 10. Thus, a significant improvement in the joining strength between the base 10 and the sealing member 20 can be expected. Although the sealing member 20 is illustrated in such a manner that it is separated from the cover part in FIGS. 14(*a*) and 14(*b*) for the ease of understanding, in actuality, the sealing member 20 and the base 10 cannot be separated after bonding.

As has been described above, the embodiments include the following various aspects.

(1) A connector cap waterproof structure comprising: a casing of an electronic device;

a connector disposed inside a connector opening provided in the casing; and a connector cap that fits to the connector opening in a watertight manner, the connector cap including:

a base;

a sealing member formed in a ring-like shape on a periphery of the base; and a flexible member that is formed integrally with the base and extends in a tongue-like shape toward the inside of the casing, the flexible member including a hook portion at a free end thereof so as to be engaged with an engaging portion of the casing when the connector cap is removed from and pulled out of the connector opening, and the flexible member being provided in an inner area enclosed by the ring-like sealing member.

(2) The connector cap waterproof structure according to (1), wherein the base includes a connector facing portion on a surface facing the connector opening, and wherein the flexible member protrudes from the connector facing portion.

(3) The connector cap waterproof structure according to (2), wherein the base is formed of a thermoplastic resin, and wherein the connector facing portion is formed of a thermoplastic elastic material.

(4) The connector cap waterproof structure according to (3), wherein the base and the connector facing portion are formed integrally.

(5) The connector cap waterproof structure according to any one of (1) to (4), wherein concaves and convexes are formed on a joint surface of the base with respect to the sealing member so as to increase the joining strength between the sealing member and the base 10.

(6) A connector cap that fits to a connector opening provided in a casing of an electronic device in a watertight manner, the connector cap comprising:

a base;

a sealing member formed in a ring-like shape on a periphery of the base; and a flexible member that is formed integrally with the base and extends in a tongue-like shape toward the inside of the casing, the flexible member including a hook portion at a free end thereof so as to be engaged with an engaging portion of the casing when the connector cap is removed from and pulled out of the connector opening, and the flexible member being provided in an inner area enclosed by the ring-like sealing member.

(7) The connector cap according to (6), wherein the base includes a connector facing portion on a surface facing the connector opening, and wherein the flexible member protrudes from the connector facing portion.

(8) The connector cap according to (7), wherein the base is formed of a thermoplastic resin, and wherein the connector facing portion is formed of a thermoplastic elastic material.

(9) The connector cap according to (8), wherein the base and the connector facing portion are formed integrally.

(10) The connector cap according to any one of (6) to (9), wherein concaves and convexes are formed on a joint surface of the base with respect to the sealing member so as to increase the joining strength between the sealing member and the base 10.

Although preferred embodiments have been described above, various modifications and changes other than those discussed above are possible. That is, it should be understood that it would be obvious for those skilled in the art that various modifications, combinations, and other embodiments may occur due to design requirements and other factors insofar as they are within the scope of the claims or the equivalents thereof.

For example, the size and detailed shape of the connector cap may vary depending on the type of the connector.

Although the second embodiment has been described as being dependent on the first embodiment, it does not necessarily have to be dependent on the characteristics of the first embodiment; it may be regarded as an independent embodiment.

REFERENCE SIGNS LIST

5, 5*a* to 5*d*: connector cap, 10, 10*a*, 10*b*, 10*c*, 10*d*: base, 12: handle, 14: groove, 15*a*: decoration plate, 15*b*: decoration plate, 15*c*: decoration plate, 15*d*: decoration plate, 16: rib, 17: seating portion, 18, 18*a*: convex portions, 19, 19*a*, 19*b*: concave portions, 19*c*: bridges, 20: sealing member, 21, 21*a*, 21*b*: convex portions, 22, 22*a*: concave portions, 23: joint surface, 30: connector facing portion, 31, 31*a*, 31*b*, 31*c*, 31*d*: flexible member, 32, 35: claw portion, 33, 34: rib, 36, 36*a*, 36*b*, 36*c*, 36*d*: hook portion, 37, 38: groove, 51, 52, 53, 54: connector cap, 100: electronic device, 101: casing, 105: cap, 112*a*, 112*b*, 112*c*, 112*d*: connector opening, 113: raised portion, 115*a*, 115*b*, 115*c*, 115*d*: engaging portion, 120: waterproof member, 130: gasket, 131: flexible member, 131*a*: hook portion, 135: claw portion, 136: hook portion, 150: connector, 160: casing, 160*a*: casing portion, 160*b*: casing portion, 161, 162: opening, 163: connector opening, 165: engaging portion

What is claimed is:

1. A connector cap for use in a portable electronic device comprising:

a base;

a connector-facing portion formed integrally with the base; and a sealing member formed of an elastic material in a ring-like shape and joined to the base, wherein the connector-facing portion includes a flexible member that has an elongated shape and is configured to extend away from the base and toward an inside of a casing of the portable device, wherein the flexible member is disposed from a position on the connector-facing portion that is within an inner area enclosed by the ring-like shape of the sealing member.

2. The connector cap according to claim 1, wherein the connector-facing portion includes one or more rib members configured to cover a connector opening provided in the casing of the portable device and disposed from a position on the connector-facing portion that is within an inner area enclosed by the ring-like shape of the sealing member.

3. The connector cap according to claim 1, wherein the connector-facing portion includes a plurality of claw portions configured to engage with a connector opening provided in the casing of the portable device and maintain a tight contact between the connector cap and the connector opening, and disposed from a position on the connector-facing portion that is within an inner area enclosed by the ring-like shape of the sealing member.

4. The connector cap according to claim 1, wherein the sealing member is attached to the base by liquid silicone injection molding.

5. The connector cap according to claim 1, wherein concave and convex portions are formed on a joint surface of the base with respect to the sealing member, and the sealing member includes concave and convex portions which complement the concave and convex portions formed on the joint surface of the base.

6. The connector cap according to claim 5, wherein the joint surface of the base has been subjected to graining or blasting.

7. The connector cap according to claim 1, wherein a continuous rib is formed on a joint surface of the base with respect to the sealing member, and the sealing member includes a continuous groove that is configured to wrap around the continuous rib.

8. The connector cap according to claim 1, wherein T-shaped concave and convex portions are formed on a joint surface of the base with respect to the sealing member, and the sealing member includes T-shaped concave and convex portions which complement the concave and convex portions formed on the joint surface of the base.

9. The connector cap according to claim 1, wherein a plurality of portions of the sealing member each wrap around and hold a respective portion of the base discontinuously over the circumference of the ring-like sealing member.

10. The connector cap according to claim 1, wherein the base is formed of a thermoplastic resin, and the connector facing portion is formed of a thermoplastic elastic material.

11. A portable electronic device comprising:

a casing;

a connector disposed inside a connector opening provided in the casing; and a connector cap that fits to the connector opening in a watertight manner, the connector cap including:

a base, a connector-facing portion formed integrally with the base, and a sealing member formed of an elastic material in a ring-like shape and joined to the base, wherein the connector-facing portion includes a flexible member that has an elongated shape and is configured to extend away from the base and toward an inside of a casing of the portable device, wherein the flexible member is disposed from a position on the connector-facing portion that is within an inner area enclosed by the ring-like shape of the sealing member.

* * * * *